US006051765A

United States Patent [19]

Regenberg et al.

[11] Patent Number: 6,051,765

[45] Date of Patent: Apr. 18, 2000

[54] GUITAR WITH CONTROLLED NECK FLEX

[75] Inventors: David C. Regenberg; Richard F. Regenberg, both of Madison; Travis J. Cox, Poynette, all of Wis.

[73] Assignee: M-TEC Corp., Middleton, Wis.

[21] Appl. No.: 08/762,200

[22] Filed: Dec. 6, 1996

[51] Int. Cl.[7] ..... G10D 3/00

[52] U.S. Cl. ..... 84/293; 84/267; 84/291

[58] Field of Search ..... 84/267, 268, 291, 84/292, 293

[56] References Cited

U.S. PATENT DOCUMENTS

| | | | |
|---|---|---|---|
| 2,148,589 | 2/1939 | Stathopoulo | 84/293 |
| 2,510,775 | 6/1950 | Forcillo | 84/293 |
| 3,159,072 | 12/1964 | Burns et al. | 84/293 |
| 3,438,297 | 4/1969 | Ogletree | 84/267 |
| 3,769,871 | 11/1973 | Cawthorn | 84/291 |
| 3,901,119 | 8/1975 | Siminoff | 84/267 |
| 4,074,606 | 2/1978 | Fender | 84/293 |
| 4,203,342 | 5/1980 | Montgomery et al. | 84/293 |
| 4,290,336 | 9/1981 | Peavey | 84/529 |
| 4,722,260 | 2/1988 | Pigozzi | 84/314 |
| 4,930,389 | 6/1990 | Kunstadt | 84/293 |
| 4,953,435 | 9/1990 | Chapman | 84/293 |
| 5,249,498 | 10/1993 | Wilfer et al. | 84/293 |
| 5,465,642 | 11/1995 | Goto | 84/293 |

OTHER PUBLICATIONS

"Truss Rods," Stewart–McDonald Catalog page, Stewart–Macdonald Manufacturing Company, Inc., Athens, Ohio (1996).

Exhibit A is a top view photograph of a Martin truss rod assembly having a rod within a channel member.

Exhibit B is a top view photograph of a Martin truss rod assembly with the rod separated from the channel member.

*Primary Examiner*—William M. Shoop, Jr.
*Assistant Examiner*—Kim Lockett
*Attorney, Agent, or Firm*—Lathrop & Clark LLP

[57] ABSTRACT

A guitar neck is formed with a protruding trapezoidal heel which extends into a pocket formed at the neck end of the body. The tendency of the strings to bend the neck is counteracted by a truss rod assembly which is positioned in a contoured channel formed in the neck beneath the fingerboard. The assembly has a threaded stainless steel rod which extends through an aluminum U-channel, with one end extending beyond the U-channel beneath and adjacent the first fret of the fingerboard, where it is fixed to the U-channel, and the other end extending out of the U-channel adjacent the neck-body joint, where an adjustable hex nut is threaded on the rod which bears on a washer. Two cylindrical spacers are fixed to the rod within the U-channel at positions upward of the neck joint which serve to hold the rod in the center of the U-channel between the U-channel legs, and also spaced outwardly from the base of the U-channel to thereby cause the rod to bow away from the base into the contoured channel in the neck. Tightening the hex nut causes the rod to straighten out, thus forcing the U-channel to flex into a curve which counteracts the bending of the neck applied by the string tension.

22 Claims, 4 Drawing Sheets

GUITAR WITH CONTROLLED NECK FLEX

FIELD OF THE INVENTION

The present invention relates to guitars in general, and to solid body electric guitars in particular.

BACKGROUND OF THE INVENTION

Construction of musical instruments has for millennia presented a challenge to the world's artisans. Many competing requirements of a fine instrument must be balanced by the craftsman. Paramount is the maintenance of the proper relationship of the notes sounded. In addition the instrument should permit accurate manipulation to give the musical performer the creative response desired. Secondary requirements from a musical standpoint, but of keen interest from an economic standpoint, are the appearance and cost of the instrument.

Guitars of one sort or another have been played since at least the sixteenth century. Early guitars were of hollow body construction. The hollow body provided resonance and acoustical amplification to the plucked strings. So long as the guitar was played in chamber groups and before small audiences, the natural sounding of the hollow body acoustic guitar was of sufficient volume. With the increasing use of the guitar as an accompanying and lead instrument in twentieth century popular music, great strides were made in producing instruments which could carry to a larger audience, and which could be heard within a multi-piece band. The development of an acoustic guitar with great volume culminated with the large guitars of the 1930's, for example the Martin D-28 and the Gibson archtop Super 400.

Changing musical styles and performance venues, however, placed demands in terms of volume which even the most advanced acoustical designs could not satisfy. Popular performers required instruments which could penetrate the high ambient noise of a honkytonk or crowded dance hall. Many pioneer guitar designers worked to address the problem by providing electric amplification to the vibration of the guitar strings. Adolph Rickenbacker produced a prototype electric guitar in 1931. Known as the "Frying Pan," this elemental electric guitar consisted of a wooden neck connected to a minimal solid body. This guitar employed a simple transducer or pickup comprised of two horseshoe magnets enclosing a coil beneath the strings. In a guitar pickup, vibrations of the metal guitar strings induce a current in the coil, which is then conveyed by a cord or cable to a separate amplifier.

By providing artificial amplification to the vibrations of the strings, the shape of the guitar body was freed from the restrictions imposed by acoustic design considerations. An extreme example of this was the prototype solid body electric guitar designed by Les Paul in 1939–1941 known as "The Log." This guitar connected a wooden guitar neck to a rectangular block of wood with pickups mounted on it. The traditional S-curved sides of an acoustic guitar were merely screwed onto the central block—serving only an ornamental purpose.

Further developments in solid body guitar construction included the Fender Broadcaster and Telecaster of 1950–1951, and the Fender Stratocaster of 1954. Both body styles became extremely popular, and variations of these instruments, as well as accurate replicas, are still manufactured and played today.

Solid body guitar construction, although requiring less demanding construction techniques than the thin wood bending required for acoustic guitars, is nonetheless an exacting process. Guitar performers desire an instrument that will stay "in tune" through protracted performances, that will be responsive to minute variations in performance technique, and that will yield a satisfying and rich sound. The timbre or "tone" of the guitar is of almost mystical concern to guitar players and afficionados, and each guitar manufacturer takes exquisite care to address this concern. While the independent guitar maker may painstakingly custom craft each instrument to achieve the desired results, the mass producer of guitars must, in order to keep costs at a reasonable level, work from a design which is repeatable and consistent.

The wooden guitar neck is subject to twisting or bending towards the body. This bending results from the high levels of tension applied to the metal strings which extend from the tuning heads fixed to the headstock at the far end of the neck to the bridge located at the far end of the body. The strings tend to cause the wood of the neck to bend about the neck-body joint, impairing playability and intonation. The conventional response to neck bending is to insert a metal truss rod into a channel in the neck, and to tighten the rod to counteract the bending. This simple truss rod is not a complete answer however, because the counteracting forces of the simple truss rod do not exactly balance the bending imposed by the strings. The bow of the wood neck due to temperature and humidity varies with the seasons. In addition, it varies with different string gauges and tunings. Martin Guitars manufactures a truss rod assembly having a U-shaped channel with a single spacer on a threaded rod positioned closer to the headstock end of the channel than to the body end. Yet this assembly still fails to eliminate distortion of the neck.

Necks having greater cross-sectional area will be stiffer and hence offer greater resistance to bending. Yet from a player's perspective, a thinner neck is desirable for its improved playability.

What is needed is a guitar of economical construction with structural features which preserve the position of the neck with respect to the body to provide an instrument of improved stability and tone.

SUMMARY OF THE INVENTION

The solid body electric guitar of this invention has improved stability of the neck with respect to the body. The tendency of the strings to bend the neck is counteracted by a truss rod assembly which is positioned in a contoured channel formed in the neck beneath the fingerboard. This truss rod assembly allows a guitar neck to be employed which is of small cross-sectional area for improved playabilty, yet which is resistant to bending. The truss rod assembly has a threaded stainless steel rod which extends through an aluminum U-channel. The legs of the U-channel extend away from the fingerboard, so that the base of the U-channel engages against the back of the fingerboard. One end of the rod extends beyond the U-channel at a position between the nut and the first fret of the fingerboard, where it is held against the U-channel with a square block which is welded to the rod. The other end of the rod extends out of the U-channel adjacent the neck body joint, where an adjustable hex nut is threaded on the rod with a square washer bearing against the end of the U-channel. Two cylindrical spacers through which the rod passes are fixed within the U-channel at positions upward of the neck joint. The square block and square washer press against the contoured recess in the neck back to hold the rod at the ends against the floor of the channel. The two spacers hold the rod in the center of the U-channel between the U-channel legs, and also space the rod outwardly from the base of the U-channel to thereby cause the rod to bow away from the base into the contoured channel in the neck. When the hex nut on the end of the rod is tightened, the rod tends to straighten out, and thereby cause the u-channel to flex into a curve. The shape of the curve is dictated by the specific placement and distance between the spacers and the amplitude of the curve is dictated by the thickness of the spacers and the amount of tightening of the hex nut, the resistance of the U-channel and related forces. The truss rod assembly alleviates problems related to inconsistent bowing or curvature of the neck, improving the playability of the instrument.

It is an object of the present invention to provide a guitar which resists bending of the neck in response to tension applied to the strings.

It is an additional object of the present invention to provide a solid body electric guitar which is of sturdy construction yet which is easily disassembled.

It is a further object of the present invention to provide a guitar in which the tendency of the strings to deform the neck is more accurately counterbalanced by a resisting force exerted by an adjustable structure positioned within the neck.

It is another object of the present invention to provide a guitar that can maintain good playability and intonation.

It is also an object of the present invention to provide a guitar neck which can accommodate widely varying deformation forces due to the wide variety of tunings and gauges of strings and variations due to deformation of wood from changes in temperature and humidity, especially seasonal changes.

It is an additional object of the invention to make feasible a slender neck design and accommodate a wide variety of forces due to the wide variety of string gauges, tunings and seasonal changes (varying temperatures and humidy causing expansion and contraction of the wood).

It is yet another object of the present invention to provide a guitar with a slender neck which has strength, stability and adjustability.

Further objects, features and advantages of the invention will be apparent from the following detailed description when taken in conjunction with the accompanying drawings.

DESCRIPTION OF THE PREFERRED EMBODIMENT

Figure 1:
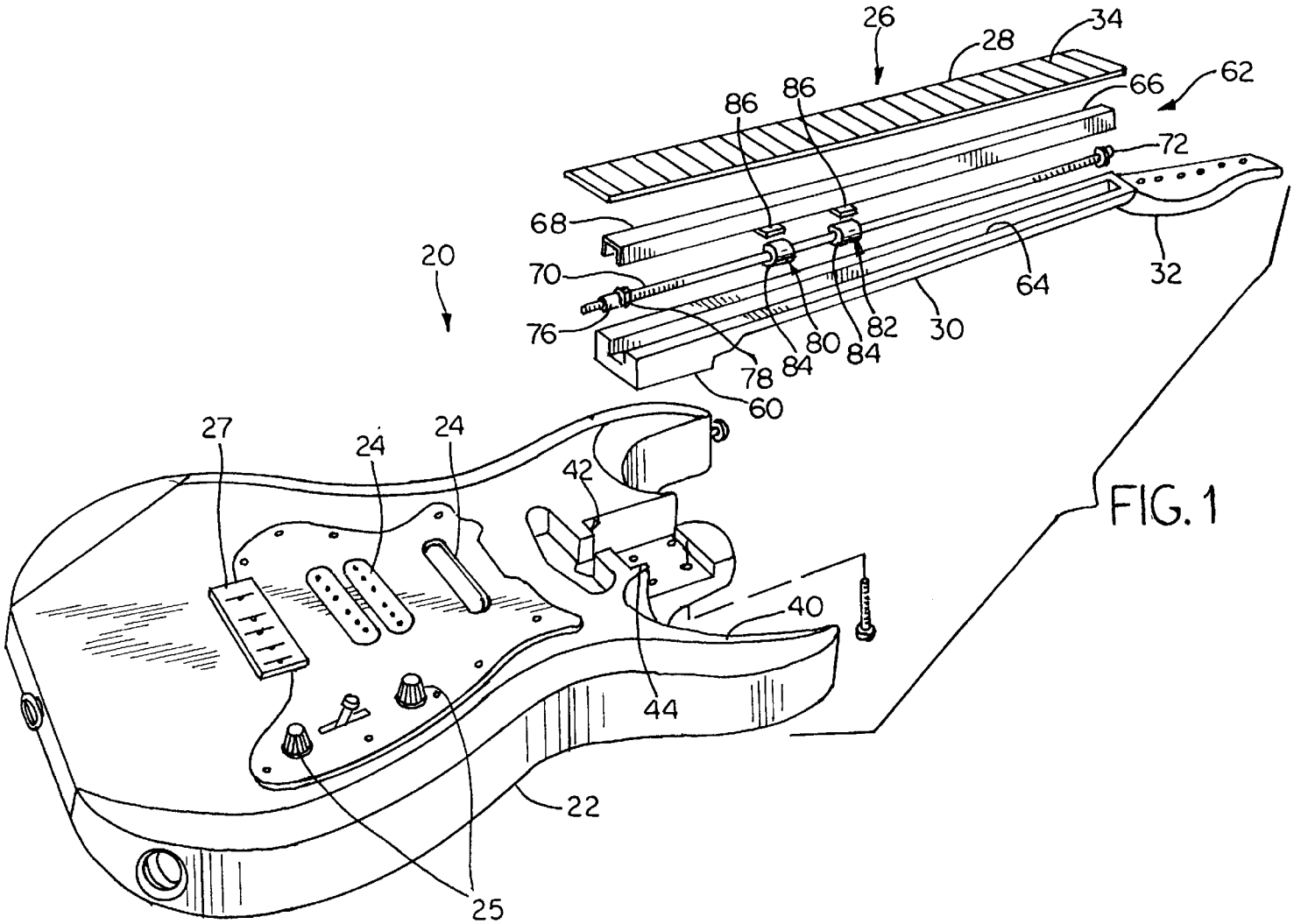
FIG. 1 is an exploded perspective view of the body and neck assemblies of the solid body electric guitar of this invention.
Figure 2:
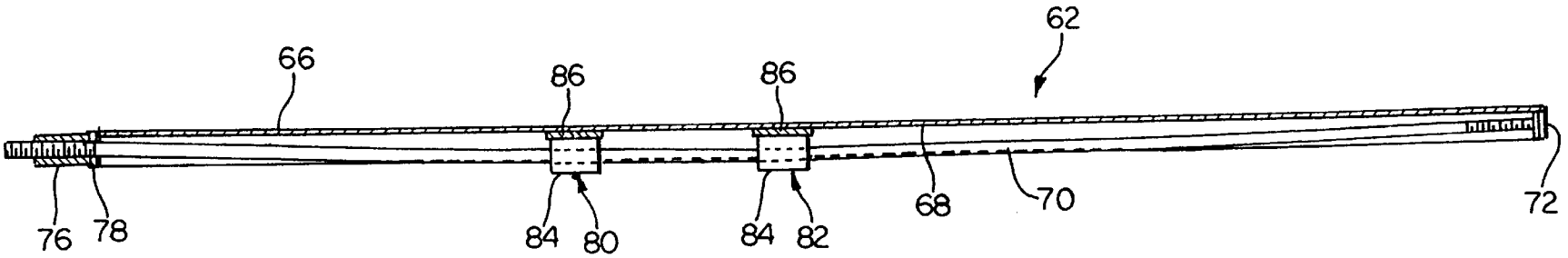
FIG. 2 is a cross-sectional view of the truss rod assembly of the guitar of FIG. 1, with the truss rod and spacers shown in full view.

Referring more particularly to FIGS. 1–8, wherein like numbers refer to similar parts, an electric guitar 20 of the present invention is shown in FIG. 1. The guitar 20, shown with strings removed and in exploded view in FIG. 1, has a contoured wooden body 22 in which a number of cavities are formed to receive such elements of hardware as the guitar pickups 24, tone and volume control knobs 25, bridge 27, vibrato unit, etc. The neck 26 is a separable wooden element, commonly composed of two wooden components: a fingerboard 28 and a neck back 30. The neck back 30 includes the headstock 32 to which the tuning machine heads 33 are mounted. The fingerboard 28 may be of a different species of wood than the neck back 30, and has a number of frets 34 positioned to protrude above the fingerboard surface and spaced at precise distances along the fingerboard to make possible the sounding of the notes of a musical scale. Strings 36 extend from the machine heads 33 to the bridge 27. The strings 36 are brought into tune by applying tension to them by adjustment of the machine heads 33.

A guitar is played by depressing the strings 36 at particular frets 34. For consistent playability the strings ideally extend above the surface of the fingerboard 28 at a controlled height. Typically the strings will be closer to the fingerboard by the "nut" than at the body end of the neck to accommodate the deviation of the string as it vibrates (the amplitude being greatest at the center of the string and with the greater string length). This variation is typically on the order of 1/32 inch to 1/16 inch.

The strings, which are under simple tension between the machine heads 33 and the bridge 27, describe a straight line. The effect of this string tension on the wooden neck 26 is illustrated in greatly exaggerated form in FIG. 3. The neck will be displaced from the plane of the body 22, with the greatest displacement being observed at a position most distant from the body. At the joint between the neck and the body, where the greater stiffness and weight of the body comes into play, there is little or no displacement of the neck. Yet any curvature of the neck 26 will tend to detract from the ideal even spacing of the strings from the fingerboard 28. If the strings 36 come so close to the fingerboard 28 as to touch it, the sounding of the strings will be deadened, or the strings may "buzz" against the fingerboard. If the strings 36 are spaced too far from the neck, the performer may experience difficulty in fully depressing the strings, or the strings may be depressed so much in being fretted that the pitch of the string is distorted by the excessive extension of the string.

Although a perfectly stiff neck 26 would be desirable, the need for a lightweight instrument, as well as for a narrow neck which allows the player's hand to move easily around it, puts an upper limit on the mass and volume of the neck.

The neck 26 is connected by screws to the body 22, and has interlocking structure formed on the neck 26 and the body 22 which resist shifting of the neck 26 which still permits ready disassembly of the neck 26 from the body 22 for adjustments, service and repair. Such adjustments may be particularly needed during periods of dramatic environmental change, for example during the shift between a dry winter and a moist spring, or between a warm summer and a cool fall and winter. In addition, adjustments may be needed when a player changes gauge of strings.

Figure 7:
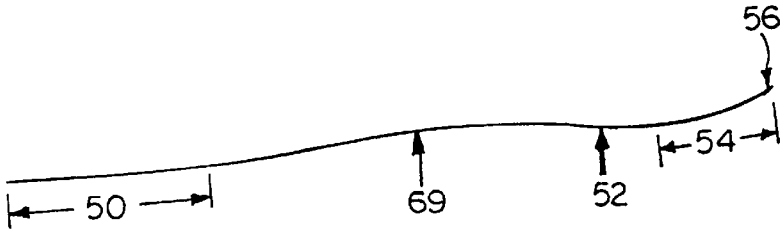
FIG. 7 PRIOR ART
FIG. 7 is an exaggerated schematic view of the resultant neck distortion of the prior art arrangment of FIG. 6.

Conventionally a simple threaded rod has been inserted in a square channel in the neck, and anchored on structure in the neck on each end. As illustrated schematically in exaggerated form in FIG. 6, tightening a nut on the threaded rod will cause the rod to bow, counteracting to some extent the bowing introduced by string tension. Yet the simple curve of the tensioned rod will result in a high point 69 or maximum counteracting of the neck bow at a position approximately at the center of the rod. As shown in FIG. 7, because the rod's position of maximum deflection does not coincide with the maximum deflection of the neck, the bowing of the neck is not canceled out, but merely replaces a simple curved neck with a compound curve—a condition which is also undesirable. The prior art neck will have a relavtively straight section 50 in the region of the neck joint, and will have a bow or high point 69, followed by a dip 52 as it approaches the headstock, and a rising region 54 at the end of the fingerboard. Furthermore, a guitar neck 26 is not of constant stiffness along its length. The width of the neck increases as it extends from the headstock 32 to the heel end. Furthermore, the neck is much thicker at the heel 60, and is also rigidly connected to the very stiff body 22 at the heel.

Figure 5:
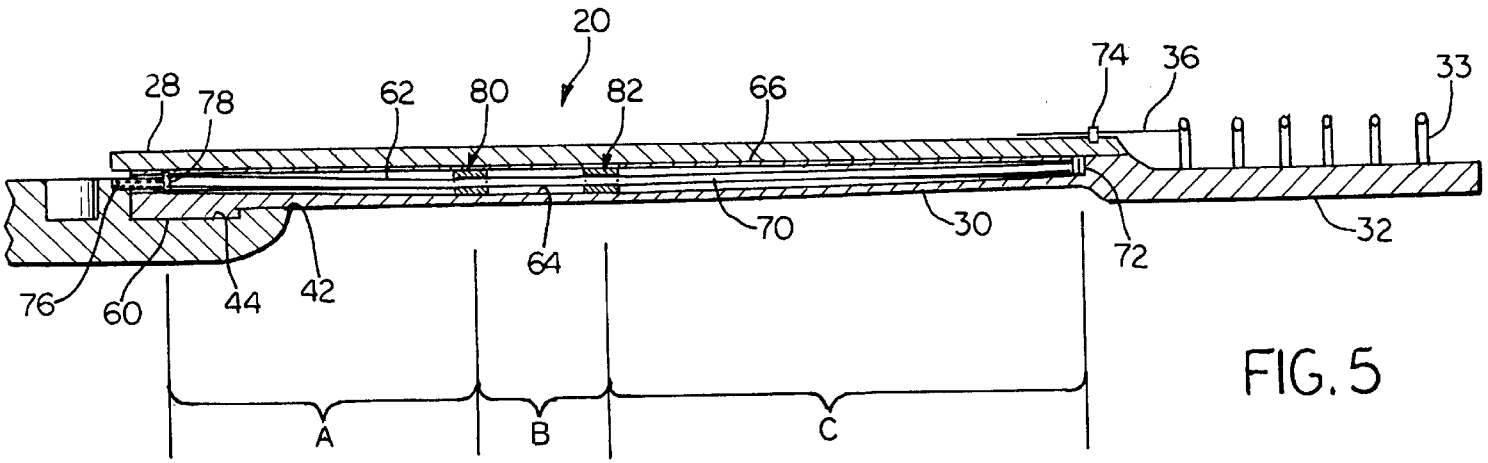
FIG. 5 is a cross-sectional view of the guitar of FIG. 4 taken along section line 5—5.
Figure 6:
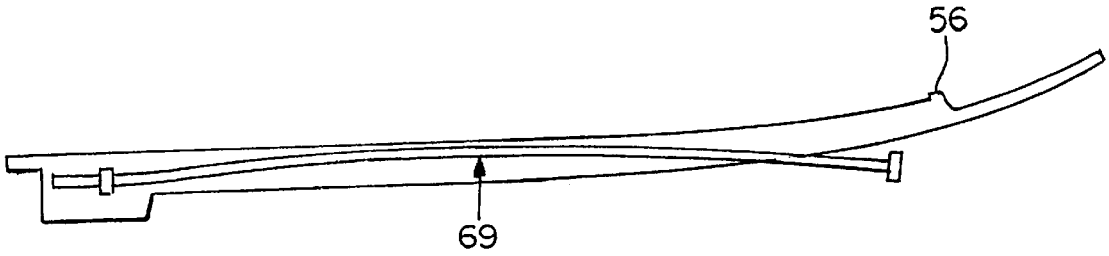
FIG. 6 PRIOR ART
FIG. 6 is an exaggerated schematic view of the deflection on the neck and the counteracting deflections caused by a prior art truss rod.

A close to ideal unbowed neck 26 is achieved in the guitar 20 of this invention, by the provision of a truss rod assembly 62 which is positioned in a contoured recess 64 formed in the neck back 30, and best shown in FIG. 5. The truss rod assembly 62, shown in FIG. 2, has a U-shaped aluminum channel member 66 which is disposed in the recess 64 directly beneath the fingerboard 28. The open side of the channel member 66 faces away from the fingerboard 28, so that the floor 68 of the U-channel extends beneath the fingerboard 28.

A threaded stainless steel rod 70 extends through the channel member 66. A square metal block 72 is welded onto the end of the rod 70 at the headstock end of the fingerboard approximately beneath the start of the fingerboard at the string "nut" 74. The "nut" is positioned at the start of the fingerboard, and has slots through which all the strings extend on their way to the bridge 27. It is the portions of the strings between the "nut" 74 and the bridge which are sounded when the strings are plucked. The headstock end of the channel member 66 terminates in close proximity to and beneath the "nut" 74, preferably within 10–15 mm of the "nut" along the axis of the neck. The square block 72 is received within the square-channel-like recess 64 in the neck back 30 and thereby prevented from rotating.

The recess 64 holds the square block 72 closely adjacent the floor 68 of the channel member 66 at the headstock end. The opposite end of the rod 70 extends from the U-channel and out of the neck 26 beneath the fingerboard 28, as best shown in FIG. 5, where a long adjustment nut 76 is threaded onto the rod to bear through a square washer 78 on the end of the U-channel member 66. The square washer is engaged within the recess 64 to hold the body end of the rod adjacent the channel member floor 68. The square washer 78 is engaged against the body end of the channel member 66 by the adjustment nut to hold the rod in close engagement with the floor 68 of the channel 66. Two spacers 80, 82 are placed along the rod 70 and are positioned within the channel member 66. Each spacer is comprised of a cylindrical sleeve 84 through which the rod extends, and a ⅛ inch thick bar stock member 86 which extends within the channel 66 on the floor 68. Because the positioning of the spacers 80, 82 is important to the performance of the assembly 62, the spacers should be fixed with respect to the rod 70, preferably by gluing both the sleeve 84 and the bar stock members 86 to the channel member 66 with epoxy. The spacers 80, 82 serve to space the rod 70 from the floor 68 of the channel member 66. The combined spacing of the surface of the rod from the floor 68 is about 0.191 inches. The adjustment nut 76 when tightened holds the ends of the rod 70 in close engagement to the floor 68 of the channel member 66, while the spacers 80, 82 position portions of the rod away from the floor. The recess 64 in the neck back 30 is contoured to provide space for the spacers 80, 82 and the rod 70 as it protrudes above the channel member 66. In particular, cavities 88 are positioned beneath each spacer 80, 82 to accept portions of the spacers therein.

Figure 3:
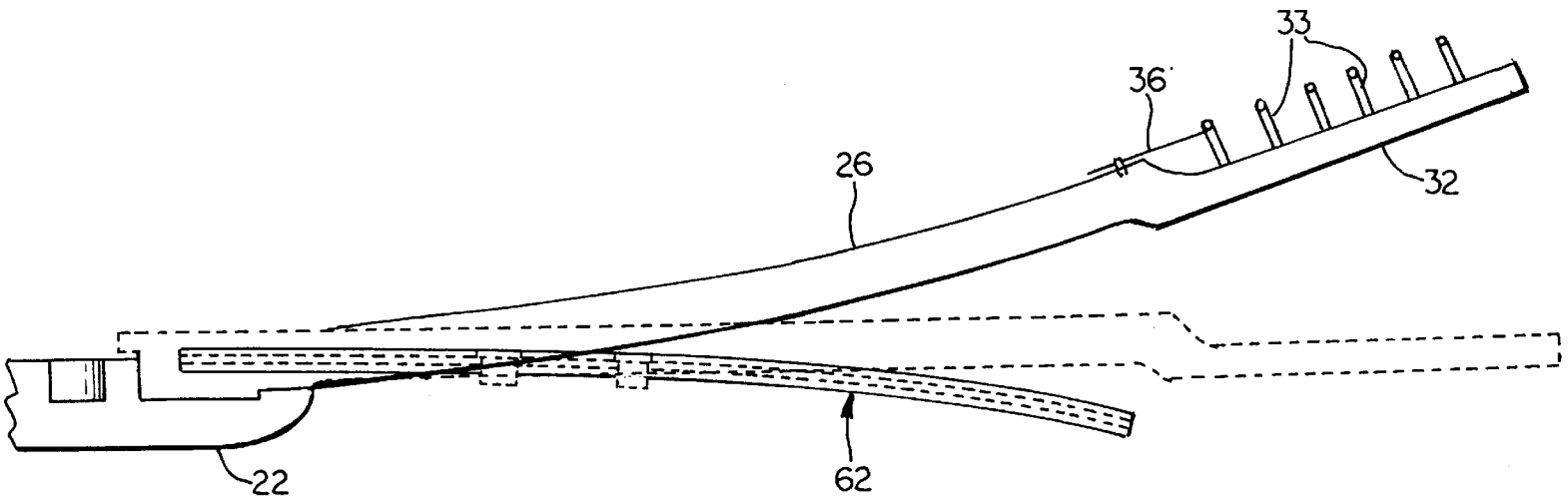
FIG. 3 is a schematic view, showing in exaggerated terms the results of the bending forces of the guitar strings and the results of the counteracting bending forces of the truss rod assembly.
Figure 4:
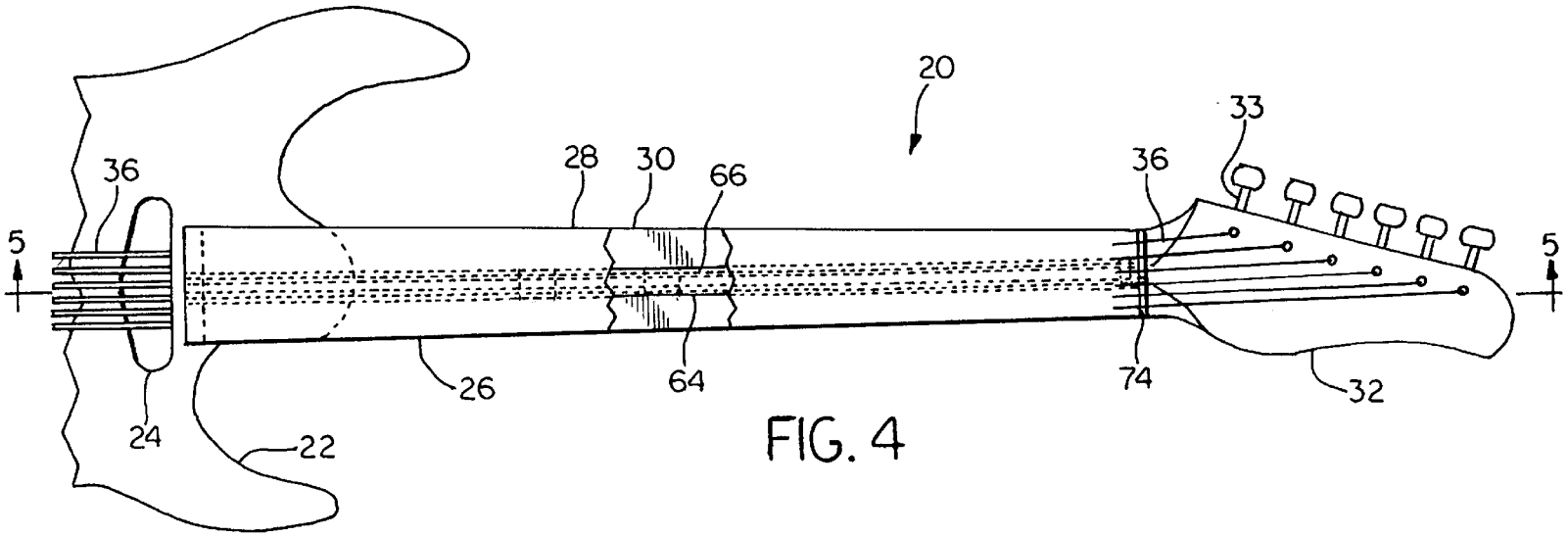
FIG. 4 is a fragmentary top plan view of the assembled guitar of this invention, with the truss rod assembly of this invention shown in hidden view.
Figure 8:
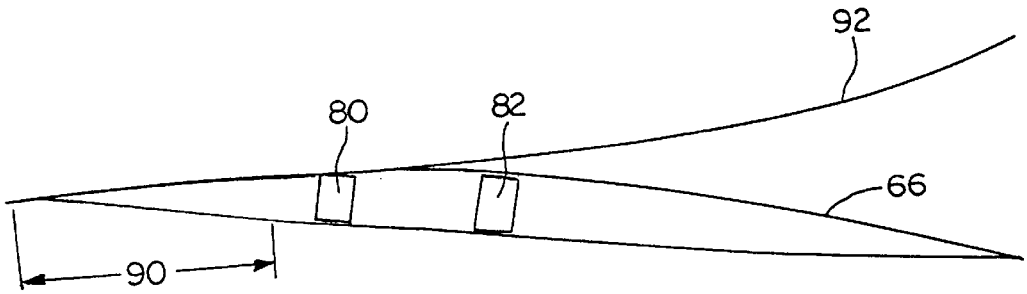
FIG. 8 is an exaggerated schematic view of the deflection of the truss rod assembly of the guitar of FIG. 1.

As shown in FIG. 5, three distinct regions are defined along the truss rod assembly 62. A first region A extends between the square washer 78 and the first spacer 80. A second region B extends between the first spacer 80 and the second spacer 82. A third region C extends between the second spacer 82 and the square block 72 beneath the instrument "nut" 74. Because of the stiffness characteristics and geometry of the neck, the deflection of the neck 26 caused by the strings 36 tends to increase continuously from the body connection of the neck to the headstock 32, as illustrated in FIG. 3. The counteracting forces of the truss rod assembly 62 are disposed to address the conditions in each of the regions A, B, and C, as shown in FIG. 8. In the schematic view of FIG. 8, the uncorrected curve of the neck is designated 92, and the neck joint region is indicated by the width 90.

As the adjustment nut 74 is turned and tightened, the square washer 78 will be brought closer to the metal block 72, forcing the ends of the channel member 66 closer together. As the nut 74 is advanced, the rod 70 is placed in tension, while the channel member 66 is placed in compression. The untightened disposition of the rod 70 is in a shallow curve concave toward the fingerboard 28, as shown in FIG. 5. This concavity is brought about because the spacers 80, 82 push the rod 70 away from the floor 68 of the channel member 66, while the ends of the rod are held against the floor. Tightening of the adjustment nut 74 tends to straighten out the curved rod. Yet because the second section B between the two spacers is elevated above the channel member floor 68 by the spacers, it will tend to remain undistorted while the ends of the channel member 66 are brought to the same level as section B. As shown in FIG. 8, the result is that the maximum deflection occurs in region C, precisely where the maximum distortion of the neck 26 is experienced. The end of the channel member 66 adjacent the square washer 78 on the body side of the neck 26 will also be flexed and tend toward the same level as the elevated second region B. Yet because the neck joint and neck in the first region A is particularly stiff, the truss rod assembly 62 is substantially held flat along the first region A. The second region B will generally remain flat between the first spacer 80 and the second spacer 82, although it will not be in the same plane as the first region A. In region C, the assembly 62 curves downward from the second spacer to a maximum at the metal block 72 beneath the string "nut" 74.

The lengths of the regions A, B, C may vary depending on the particular neck design with which they are employed, but in general the length of the first region A will be less than the length of the third region C, and the length of the second region B will be less than the length of the first region A. For example, in a neck with a fingerboard approximately 470 mm long, the length of the first region would be about 145 mm, the length of the second region would be about 75 mm, and the length of the third region would be about 230 mm.

Although the truss rod assembly of this invention can be used to give improved neck stability in any neck design, it offers particular advantages in making possible more slender necks, having generally smaller cross-sectional areas. A slender neck has less wood in the neck, so it will not, by itself, be as stiff and resistant to bending from the force of the strings and also, from seasonal changes, as a thicker, heavier neck. As string gauges vary tremendously, the force applied by the strings against any given neck will vary substantially with the varying string gauges a player may choose to use and the tunings the player chooses to use. A thin neck, though generally desirable from a player's standpoint for its improved playability, will bend to a greater extent with varying string forces than a thicker, heavier neck. The added stiffness provided by the U-channel of the truss rod assembly, the greater deflection provided by the spacers, and the pattern of the deflection provided by the specific placement of the multiple spacers (relative to the heel of the neck, the neck-body joint, the varying thickness of the neck along its length and the length of the neck) of the guitar of this invention, provides for a thin neck of increased strength, without any substantial increase in size or weight, that remains stable and adjusts to a wide range of varying forces accurately counteracting the deformation of the neck caused by the force of the strings along the entire length of the neck.

It should be noted that although the body-neck joint of this invention has been illustrated on a double-cutaway type solid body electric guitar, it may also be employed on other body styles. In addition, the truss rod assembly of this invention could be used in acoustic, and semi-acoustic guitars. It should be understood furthermore, that the term "guitar" as used herein, encompasses both guitars and basses. When the truss rod assembly is employed in a bass having a longer neck, the length of the third region would be increased disproportionately to the length of the first region.

It is understood that the invention is not limited to the particular construction and arrangement of parts herein illustrated and described, but embraces such modified forms thereof as come within the scope of the following claims.

We claim:

1. A guitar comprising:

a body;

a neck which is connected to the body and which extends away from the body, wherein the neck has portions which define a recess which extends along the axis of the body, wherein a fingerboard is positioned on the neck, and wherein the neck has a headstock end which is spaced from the body, and a body end which is connected to the body;

a plurality of strings which are fixed to the neck and which extend to the body and are fixed to the body, the strings exerting a tension force between the neck and the body;

a U-shaped channel member which is positioned in the neck recess and has a headstock end and a body end, the channel member having a floor which is positioned beneath the fingerboard;

a rod which extends through the channel member from the body end to the headstock end, wherein the rod has threaded portions which protrude beyond the channel member body end, the rod having a body end which engages with the channel member floor, and the rod having a headstock end which engages with the channel member floor;

an adjustment nut threaded on the rod threaded portion and engaged with the channel member body end, such that the adjustment nut may be rotated to draw the adjustment nut and the channel member body end closer to the channel member headstock end, and thereby apply tension to the rod and compression to the channel member;

a first spacer having portions extending between the rod and the channel member floor to space the rod from the channel member floor away from the fingerboard, the first spacer being positioned along the rod between the headstock end of the channel member and the body end of the channel member, the rod being thereby caused to bow away from the floor of the channel member; and a second spacer having portions extending between the rod and the channel member floor to space the rod from the channel member floor away from the fingerboard, the second spacer being positioned along the rod between the first spacer and the headstock end of the channel member, wherein a first region is defined between the body end of the channel member and the first spacer, a second region is defined between the first spacer and the second spacer, and a third region is defined between the second spacer and the headstock end of the channel member, and wherein the adjustment nut may be rotated to cause the channel member to counteract the distortion of the neck caused by the string tension.

2. The guitar of claim 1 wherein the length of the third region is greater than the length of the first region.

3. The guitar of claim 2 wherein the length of the first region is greater than the length of the second region.

4. The guitar of claim 1 wherein each spacer comprises:

a cylindrical sleeve around the rod; and a flat segment of bar stock positioned between the sleeve and the channel member floor.

5. The guitar of claim 4 wherein the sleeve and the flat segment of the spacer are positioned with respect to the channel member by a quantity of adhesive.

6. The guitar of claim 1 wherein the fingerboard begins at a nut at the headstock end of the neck, and wherein the strings pass over and engage the nut, and wherein the headstock end of the channel member is within 10 mm of the nut along the axis of the neck.

7. The guitar of claim 1 wherein each spacer spaces the rod from the channel member floor by an amount greater than one eighth of an inch.

8. The guitar of claim 1 wherein the recess in the neck has cavities positioned beneath each spacer to accept portions of the spacer therein.

9. The guitar of claim 1 wherein a block is fixed to the rod at an end opposite the adjustment nut, the block being engaged against the headstock end of the channel member, and wherein the block is nonround and engages with the recess in the neck to prevent rotation of the rod.

10. The guitar of claim 1 wherein the rod engages against the headstock end and the body end of the channel member at a position adjacent to the channel member floor, such that tightening of the adjustment nut on the rod tends to raise the ends of the channel member with respect to the spacers.

11. A guitar comprising:

a body;

a neck back having portions defining a recess which extends axially along the neck back, and a headstock at one end;

a fingerboard which is fixed to the neck back to overlie the recess, the connected neck back and fingerboard defining a guitar neck with body end which is connected to the body and which extends away from the body;

a plurality of strings which are fixed to the neck and which extend to the body and are fixed to the body, the strings exerting a tension force between the neck and the body;

a channel member which is positioned in the neck recess and has a headstock end and a body end, the channel member having a floor which is positioned within the recess between the neck back and the fingerboard;

a rod which extends through the channel member from the body end to the headstock end, wherein the rod has threaded portions which protrude beyond the channel member body end, the rod having a body end which engages with the channel member floor, and the rod having a headstock end which engages with the channel member floor;

portions of the rod which extend beyond the headstock end of the channel member, and a block fixed to said portions to engage against the headstock end of the channel member;

an adjustment nut threaded on the rod threaded portion and engaged with the channel member body end, such that the adjustment nut may be rotated to draw the adjustment nut and the block closer together, and thereby apply tension to the rod and compression to the channel member;

a first spacer having portions extending between the rod and the channel member floor to space the rod from the channel member floor away from the fingerboard, the first spacer being positioned along the rod between the headstock end of the channel member and the body end of the channel member; and a second spacer having portions extending between the rod and the channel member floor to space the rod from the channel member floor away from the fingerboard, the second spacer being positioned along the rod between the first spacer and the headstock end of the channel member, wherein a first region is defined between the body end of the channel member and the first spacer, a second region is defined between the first spacer and the second spacer, and a third region is defined between the second spacer and the headstock end of the channel member, the rod thereby being mounted in a curved manner bowing away from the floor of the channel member, and wherein the adjustment nut may be rotated to cause the channel member to counteract the distortion of the neck caused by the string tension, by moving the block and the engaged channel member headstock end away from the fingerboard in a direction approximately perpendicular to the fingerboard.

12. The guitar of claim 11 wherein the degree of counteracting force applied in the third region is greater than that applied in the second region.

13. The guitar of claim 11 wherein the length of the third region is greater than the length of the first region.

14. The guitar of claim 13 wherein the length of the first region is greater than the length of the second region.

15. The guitar of claim 11 wherein each spacer comprises:

a cylindrical sleeve around the rod; and a flat segment of bar stock positioned between the sleeve and the channel member floor.

16. The guitar of claim 15 wherein the sleeve and the flat segment of the spacer are positioned with respect to the channel member by a quantity of adhesive.

17. The guitar of claim 11 wherein the fingerboard begins at a nut at the headstock end of the neck, and wherein the strings pass over and engage the nut, and wherein the headstock end of the channel member is within 10 mm of the nut along the axis of the neck.

18. The guitar of claim 11 wherein each spacer spaces the rod from the channel member floor by an amount greater than one eighth of an inch.

19. The guitar of claim 11 wherein the recess in the neck has cavities positioned beneath each spacer to accept portions of the spacer therein.

20. The guitar of claim 11 wherein a block is fixed to the rod at an end opposite the adjustment nut, the block being engaged against the headstock end of the channel member, and wherein the block is nonround and engages with the recess in the neck to prevent rotation of the rod.

21. A guitar comprising:

a body;

a neck having a headstock spaced from the body, the neck being connected to the body at an end opposite the headstock;

strings extending from the neck headstock to the body in tension, the strings tending to distort the neck by bending the neck upwards;

a recess defined in the neck beneath a fingerboard;

a compression member positioned within the recess beneath the fingerboard and having a headstock end and a body end, and a floor;

a tension member positioned within the compression member and engaged with the ends of the compression member, the tension member having a body end which engages with the compression member floor, and the tension member having a headstock end which engages with the compression member floor, a middle of the tension member being defined between the tension member body end and the tension member headstock end;

a first means for spacing the middle of the tension member from the compression member positioned between the headstock end and the body end of the compression member, and engaging the floor of the compression member;

a second means for spacing the middle of the tension member from the compression member positioned between the first means for spacing and headstock end of the compression member, and engaging the floor of the compression member, the first and second means for spacing causing the middle of the tension member to bow away from the floor of the compression member; and a means for increasing the tension on the tension member through which the compression in the compression member is increased to cause a distortion of the compression member to deflect the headstock end of the compression member in a direction away from and approximately perpendicular to the fingerboard.

22. The guitar of claim 21 wherein the forces applied to the neck by the compression member corresponds counteract the forces applied to the neck by the strings to thereby offset the tendency of the strings to distort the neck and retain the neck in an undeformed configuration.

* * * * *